US010192661B2

(12) United States Patent
Enokido et al.

(10) Patent No.: US 10,192,661 B2
(45) **Date of Patent: *Jan. 29, 2019**

(54) R—T—B BASED SINTERED MAGNET

(71) Applicant: TDK CORPORATION, Tokyo (JP)

(72) Inventors: Yasushi Enokido, Tokyo (JP); Akihiro Ohsawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 416 days.

This patent is subject to a terminal disclaimer.

(21) Appl. No.: 14/258,375

(22) Filed: Apr. 22, 2014

(65) Prior Publication Data

US 2014/0311288 A1 Oct. 23, 2014

(30) Foreign Application Priority Data

Apr. 22, 2013 (JP) ..... 2013-089524

(51) Int. Cl.
*H01F 1/053* (2006.01)
*H01F 1/057* (2006.01)

(52) U.S. Cl.
CPC ..... *H01F 1/0536* (2013.01); *H01F 1/0577* (2013.01)

(58) Field of Classification Search
CPC ..... H01F 1/0536
See application file for complete search history.

(56) References Cited

U.S. PATENT DOCUMENTS

2002/0062884 A1* 5/2002 Kaneko ..... H01F 1/058 148/301

FOREIGN PATENT DOCUMENTS

| | | | |
|---|---|---|---|
| CN | 103545079 | A | 1/2014 |
| EP | 0 101 552 | A2 | 2/1984 |
| JP | A-59-46008 | | 3/1984 |
| JP | A-4-330702 | | 11/1992 |
| JP | 2002-190404 | A | 7/2002 |
| JP | 2003-293008 | A | 10/2003 |

OTHER PUBLICATIONS

Wang et al., "Effect of Gd, Y Content on Magnetic Properties of Sintered Nd—Fe—B Permanent Magnet," Metallic Functional Materials, vol. 16, No. 2, Apr. 2009.

* cited by examiner

*Primary Examiner* — Christopher S Kessler
(74) *Attorney, Agent, or Firm* — Oliff PLC

(57) ABSTRACT

The present invention provides a permanent magnet with both a high corrosion resistance and magnetic properties compared to the existing R-T-B based magnets. It is a R-T-B based sintered magnet (wherein, R includes Y (yttrium) and R1 as essential, R1 is at least one kind of rare earth elements except Y but includes Nd as essential, and T is at least one kind of transition metal element including Fe or the combination of Fe and Co as essential). By allowing the ratio of R1 to Y (R1:Y) in the R contained in the grain boundary phase to be 80:20~35:65 in terms of the calculated molar ratio of the grain boundary phase and adding Y to the raw materials of the R-T-B based magnet, Y segregates at the triple point, and corrosion of grain boundary phase is prevented by oxidized Y.

5 Claims, 3 Drawing Sheets

R—T—B BASED SINTERED MAGNET

The present invention relates to a rare earth based permanent magnet, especially a rare earth based permanent magnet obtained by selectively replacing part of the R in the R-T-B based permanent magnet (R is a rare earth element, T is Fe or Fe with part of it replaced by Co, B is boron) with Y.

BACKGROUND

The R-T-B based magnet comprising a tetragonal compound $R_2T_{14}B$ as the main phase is known to have excellent magnetic properties, and has been considered as a representative permanent magnet with high performances since it was invented in 1982 (Patent Document 1: JPSho59-46008).

Although the R-T-B based magnet has excellent magnetic properties, the trend that the corrosion resistance is low exists due to having the rare earth element that is easily oxidized as the main component.

Therefore, in order to improve corrosion resistance of the R-T-B based sintered magnet, the surface treatment such as coating resins, plating or the like on the surface of the magnet body is usually adopted. On the other hand, by changing addition elements of the magnet body or internal structure, the study on improving the corrosion resistance of the magnet body is performed. Enhancing corrosion resistance of the magnet body is very important for improving reliability of the products after surface treatment. In addition, the simpler surface treatment also can be used than coating resin or plating so as to be advantageous for reduce the product cost.

In the prior art, for example, Patent Document 2 (JP Hei4-330702) has disclosed a technical solution in which the intermetallic compound R—C of rare earth elements between the non-magnetic R-rich phase and carbon is inhibited to be 1.0 mass % or less and corrosion resistance of the magnet is enhanced by reducing the content of carbon in the permanent magnet alloys to 0.04 mass % or less. Further, Patent Document 2 has disclosed a technical solution in which corrosion resistance is improved by setting the concentration of Co in the grain boundary phase to 5 mass % to 12 mass %.

PATENT DOCUMENTS

Patent Document 1: JPSho59-46008
Patent Document 2: JPHei4-330702

SUMMARY

However, in the existing R-T-B based sintered magnet, R in the R-T-B based sintered magnet is oxidized and hydrogen is generated due to the water such as water vapor and the like in the working environment, and then the hydrogen is adsorbed into the grain boundary phase in grain boundary. Thus, corrosion resistance of the grain boundary phase is performed and the main phase grains peel off, leading to decrease of magnetic properties of R-T-B based sintered magnet.

In addition, as described in Patent Document 1, in order to reduce the content of carbon in the magnet alloys to 0.04 mass % or less, it is necessary to sharply decrease the addition amount of the lubricant, purpose of which is to improve orientation of the magnetic field during molding in the magnetic field. Thus, the orientation of the magnet powders in the molded body decreases, the residual flux density Br after sintering reduces, and the magnet with sufficient magnetic properties can not be obtained.

The present invention is achieved by recognizing the above-mentioned situation. It is an object of the present invention to provide an R-T-B based sintered magnet with both good corrosion resistance and excellent magnetic properties.

The R-T-B based sintered (wherein, R contains Y (yttrium) and R1 as essential, R1 is at least one kind of rare earth elements except Y but containing Nd as the essential, and T is one or more kinds of transition metal elements containing Fe or the combination of Fe and Co as essential) is characterized in that the ratio of R1 to Y (R1:Y) in the R contained in the grain boundary phase is 80:20 to 35:65 in terms of the calculated molar ratio of the grain boundary phase. With such a structure, an R-T-B based sintered magnet exhibiting a high corrosion resistance and good magnetic properties will be obtained among the R-T-B based sintered magnets.

The inventors have found that Y segregates in the grain boundary phase by appropriately adding Y in the R-T-B based permanent magnet, and the action that hydrogen produced by the corrosion reaction is adsorbed into the grain boundary can be efficiently inhibited by the oxidization of segregated Y, additionally, corrosion of R towards the inside can be inhibited, and thus the corrosion resistance of the R-T-B based sintered magnet can be sharply enhanced and good magnetic properties can be obtained. In this way, the present invention could be realized.

In the present invention, the magnet with improved corrosion resistance of R-T-B based sintered magnet and exhibiting good magnetic properties can be obtained by adding Y in the R-T-B based magnet with the ratio of R1 to Y (R1:Y) contained in the grain boundary phase being 80:20~35:65 in terms of the calculated molar ratio of the grain boundary phase.

DETAILED DESCRIPTION OF EMBODIMENTS

Figure 1:
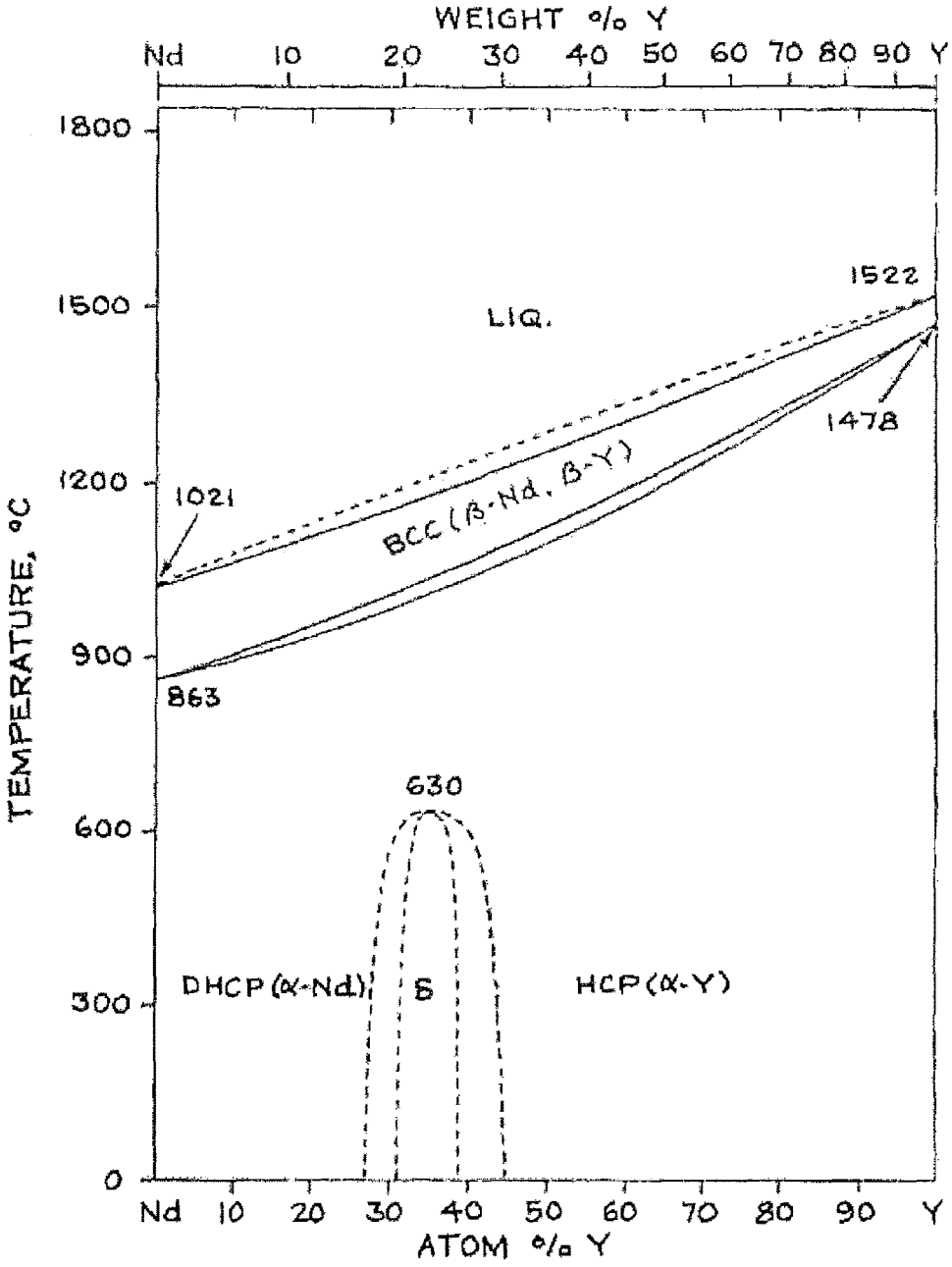
Fig.1 Prior Art
FIG. 1 is a state diagram of Nd—Y.

The present invention is described in detail based on the embodiments. Further, the present invention is not limited by the following embodiments and examples. In addition, the constituent elements in the following embodiments and examples include those easily thought of by those skilled in the art, those substantially the same and those having the equivalent scopes. Besides, the constituent elements disclosed in the following embodiments and examples can be appropriately combined or can be properly selected.

The R-T-B based sintered magnet according to the present embodiment contains 11 to 18 at % of the rare earth element R. Here, the R in the present invention contains Y (yttrium) and R1 as essential, and R1 represents at least one rare earth element except Nd and Y. If the amount of R is less than 11 at %, the $R_2Fe_{14}B$ phase as the main phase in the R-T-B based sintered magnet will not be sufficiently generated, and the soft magnetic $\alpha$-Fe and the like will precipitate and the coercivity is significantly decreased. On the other hand, if the amount of R is larger than 18 at %, the volume ratio of $R_2Fe_{14}B$ phase as the main phase will be decreased, and the residual flux density is reduced. Further, while R reacts with oxygen and the amount of the contained oxygen increases, the R-rich phase which is effective for generating coercivity reduces, leading to the decrease of coercivity.

In the present embodiment, the rare earth element R mentioned above contains Y and R1. R1 represents at least one rare earth element except Y but containing Nd as essential. Here, R1 could also contain other components which are impurities derived from the raw material or impurities mixed during the production process. In addition, if a high magnetic anisotropy field is considered to be desired, preferably R1 also contains Pr, Dy, Ho and Tb. The content ratio of R1 to Y in the rare earth element R is preferably 80:20~35:65 according to the molar ratio. The reason is that if the content of Y exceeds the range, segregation of Y in the grain boundary portion is difficult to occur and the trend of deterioration of the corrosion resistance exists. In addition, the content ratio of R1 and Y is more preferably 75:25~45:55. If the ratio of Y is less than 25%, deterioration of the corrosion resistance is caused. Besides, if the ratio is more than 55%, deterioration of the magnetic properties especially deterioration of coercivity is significant.

In addition, the corrosion resistance of a magnet body depends on corrosion of the grain boundary portion. Thus, the composition of the grain boundary portion should be controlled. The content ratio of R1 to Y in the R of the grain boundary portion is preferably 80:20~35:65 in terms of the calculated molar ratio of the grain boundary phase. The reason is that if the content of Y exceeds the range, segregation of Y in the grain boundary portion is difficult to occur and the trend of deterioration of the corrosion resistance exists.

It can be known from the state diagram of Nd—Y shown in FIG. 1 that Nd and Y form solid solution as a stable phase.

However, the R-T-B rare earth based magnet alloys are produced by cooling the melt with high temperature by means of a melting method. Thus, the stable phase can not be formed without enough time. Therefore, it can be considered that the solid solution as the stable phase is not necessarily formed, and segregation occurs. In the grain boundary portion, Y is easy to segregate if the content ratio of R1 to Y in the rare earth element R is 80:20~35:65 in terms of the calculated molar ratio of the grain boundary phase.

Figure 2:
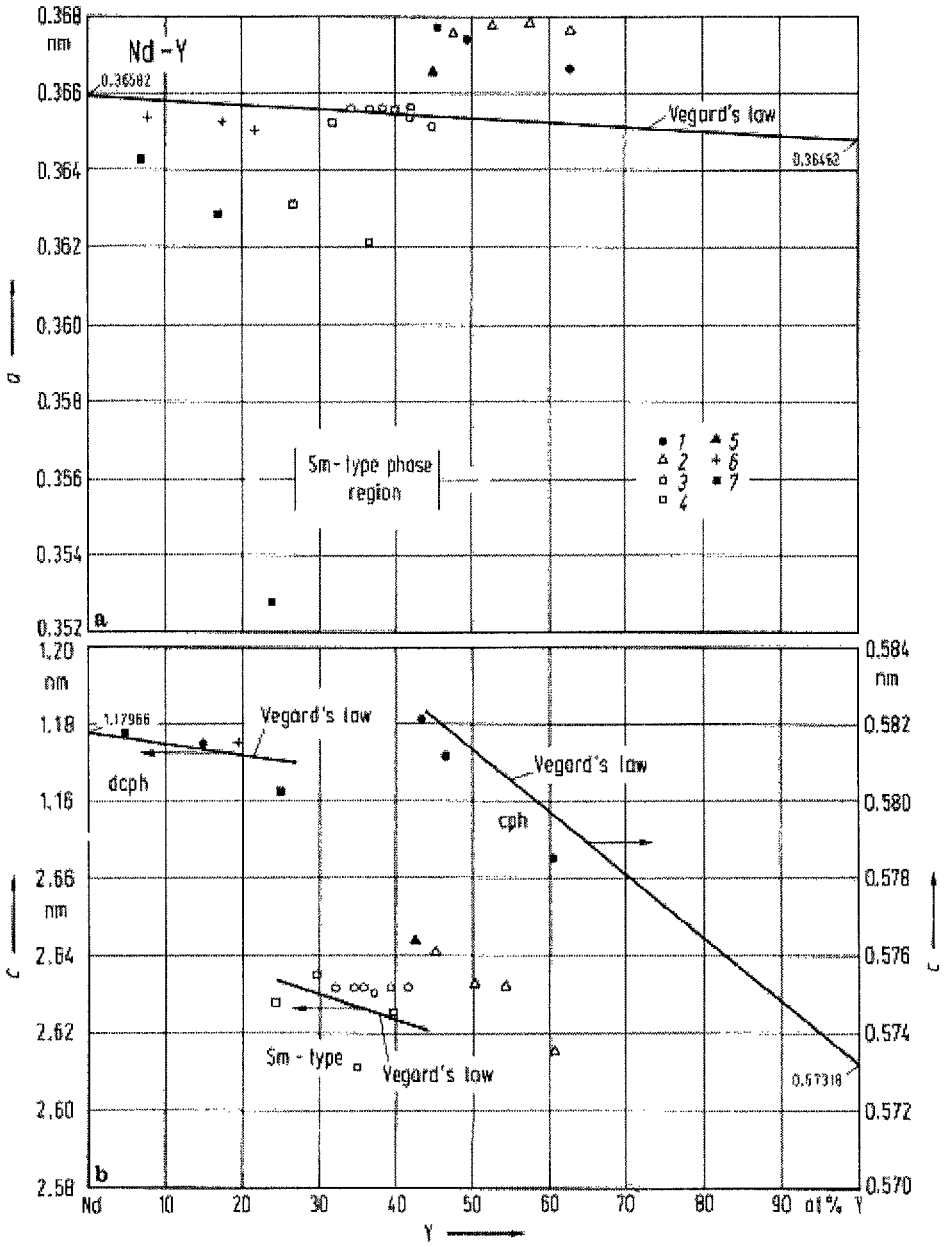
FIG. 2 shows reference images of the lattice constant of the solid solution discontinuously decreased at the range of the composition of Nd to Y in the R-T-B based sintered magnet according to the present embodiment.

The reason is not entirely clear. It has been known that the lattice constant of the solid solution discontinuously decreases at the range of the composition of Nd to Y in the R-T-B based sintered magnet according to the present embodiment (Reference Documents 1~7 and FIG. 2). The mismatching of the lattice constant is considered to influence the stability of the formation of the solid solution during alloys solidified and thus improve the segregation of Y.

(Reference Document 1) Kirkpatrick, C. G., Love, B.: 'Rare Earth Research', F. J. Nachman, C. E. Lundin, New York: Gordon and Breach (1962) 87

(Reference Document 2) Spedding, F. H., Valletta, R. M., Daane, A. H.: Trans, ASM 55 (1962) 483

(Reference Document 3) Beaudry, B. J., Michael, M., Daane, A. H., Spedding, F. H., in: 'Rare Earth Research III', L. Eyring, New York: Gordon and Breach (1965) 247

(Reference Document 4) Luddin, C. E.: AD 633558 final report, Denver Research Inst., University Den ver, Denver, Colo. (1966)

(Reference Document 5) Svechnikov, V. N., Kobzenko, G. V., Martynchuk, E. J.: Dopov. Akad. Nauk Ukr. RSR, Ser. A. (1972) 754

(Reference Document 6) Gschneidner jr., K. A., Calderwood, F. W.: Bull. Alloy Pahse Diagrams 3 (1982) 202

(Reference Document 7) Gschneidner jr., K. A., Calderwood, F. W., in: 'Binary Alloy Phase Diagrams', Second Edition, Vol, 3, T. B. Massalski, Materials Information Soc., Materials Park, Ohio (1990)

Further, when Y segregates in the grain boundary phase, the segregation is easy to arise at the triple point which is wider than two-grain boundary with the thickness of several mm. By means of analysis of two-grain boundary through TEM (i.e., transmission electron microscope), the segregation of Y can hardly be found at the two-grain boundary.

The magnet body is exposed to oxygen during pulverizating, molding and sintering the alloys. During manufacturing the R-T-B based magnet, the production method, which is exposed to oxygen as little as possible, is usually adopted. However, it can not avoid exposing to oxygen of several ppm to several thousand ppm even then. It also can be seen from Ellingham diagram that Y is easy to oxidize compared to Nd. Thus, Y at the triple point is oxidized firstly while oxidization of Nd is not that much. The segregation of Y results in relatively lessening the Nd phase at the triple point which moved to the two-grain boundary, and thus Y oxide hardly can adsorb hydrogen. Hence, the corrosion of the grain boundary phase is difficult to arise.

Figure 3:
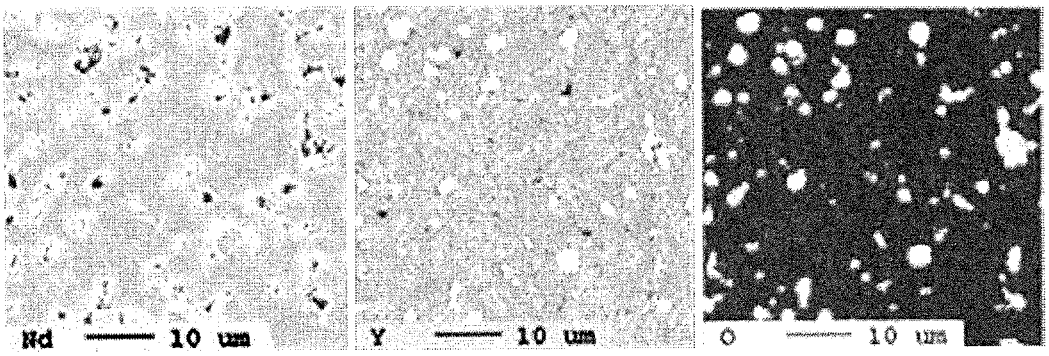
FIG. 3 shows analysis images of mapping Nd, Y and O by means of EPMA.

As an example, the analysis images of the sintered magnet produced from high-R alloys with Nd:Y=50:50 are shown in FIG. 3, and the images are obtained by cross-section electron probe micro analyzer (EPMA). Where content of the elements is high is shown with white. It could be seen that Nd and Y are separated and are located at the triple point. Especially, it can be though of that a mass of Y segregates so that Nd is pushed out from the triple point and exists at the two-grain boundary. If Nd is at the two-grain boundary, $R_2T_{14}B$ crystal grains become magnetic isolation with each other, and thus high coercivity can be achieved. Moreover, it can be known from FIG. 3 that a majority of the position of O is consistent with the segregation position of Y, and Y takes precedence of being oxidized.

The R-T-B based sintered magnet according to the present embodiment contains 5 to 8 at % of B (boron). When B accounts for less than 5 at %, a high coercivity can not be obtained. On the other hand, if B accounts for more than 8 at %, the residual magnetic density tends to decrease. Thus, the upper limit for the amount of B is 8 at %.

The R-T-B based sintered magnet according to the present embodiment may contain 4.0 at % or less of Co. Co forms a same phase as Fe but has effects on the increase of Curie temperature as well as the increase of the corrosion resistance of the grain boundary phase. In addition, the R-T-B based sintered magnet used in the present invention can contain one or two of Al and Cu in the range of 0.01~1.2 at %. By containing one or two of Al and Cu in such range, the obtained sintered magnet can be realized with high coercivity, high corrosion resistance and the improvement of temperature characteristics.

The R-T-B based sintered magnet according to the present embodiment is allowed to contain other elements. For example, elements such as Zr, Ti, Bi, Sn, Ga, Nb, Ta, Si, V, Ag, Ge and the like can be appropriately contained. On the other hand, impurity elements such as oxygen, N (nitrogen), C (carbon) and the like are preferably reduced as much as possible. Especially, the content of oxygen that damages the magnetic properties is preferably 5000 ppm or less, more preferably 3000 ppm or less. The reason is that if the content of oxygen is high, the phase of rare earth oxides as the non-magnetic component increases, leading to lowered magnetic properties.

The preferable example of manufacturing method in the present invention is described as follows.

During manufacturing the R-T-B based magnet according to the present embodiment, firstly, the raw materials alloys are prepared to obtain R-T-B based magnet with the desired composition. The alloys can be produced by strip casting method or the other known melting method in the vacuum or in the atmosphere of an inert gas, preferably in the atmosphere of Ar. Strip casting method is the one that the raw metal melts in the non-oxidizing atmosphere such as Ar gas atmosphere and etc., and then the obtained molten solution is sprayed to the surface of the rotating roll. The molten solution quenched on the roll is rapidly-solidified to become a sheet or a flake (squama). The rapidly-solidified alloys have the homogeneous organization with grain diameter of 1~50 μm.

In the case of obtaining the R-T-B based sintered magnet in the present invention, the so-called single-alloy method is applied by using one kind of alloy as the raw materials to produce sintered magnets. The single alloy method has advantages that the production method is simple with fewer steps, deviation of composition is small and it is suitable for stable manufacturing.

In addition, in the present invention, the so-called mixing method also can be applied by using the alloy (low R alloy) having $R_2T_{14}B$ crystal grains as the main body and the alloy (high R alloy) containing more R than that in low R alloy. If using the mixing method, it is easy to control the composition of the grain boundary phase and the main phase.

In the case of adopting the mixing method, the high R alloy and the low R alloy are prepared. In the present embodiment, the low R alloy is the one that contains R-T-B based compound, and preferably contains R at the range of 11~15 mol % relative to the whole low R alloy. In addition, the content of B in the low R alloy is preferably 5~7 mol %. In the present embodiment, the high R alloy means the alloys containing Y. The content of Y in the high R alloy is preferably 3~25 mol %. Further, the high R alloy is preferably the alloys containing Y and T. To be specific, Y—Fe compounds, Y—Fe—Co compounds, Y—Fe—B compounds and the like can be listed. By means of such composition of the high R alloy and the low alloy, the target structure of the grain boundary phase is easily achieved. Moreover, in the case of using the mixing method, the weight ratio of the high R alloy and the low R alloy is preferably 25:75~3:97.

The raw metals or raw alloys are weighted so as to obtain the target composition. The raw alloys are obtained by strip casting method in the vacuum or in the atmosphere of an inert gas, preferably in the atmosphere of Ar. By changing the rotating speed of the roll or the supply speed of the melt solution, the thickness of the alloys can be controlled.

The raw alloys are subjected to the pulverization process. When the mixing method is used, the low-R alloy and the high-R alloy are pulverized separately or pulverized together. The pulverization step includes a coarse pulverization step and a fine pulverization step. Firstly, the raw alloys are pulverized until a particle diameter of approximately several hundred μm. The coarse pulverization is preferably performed by using a coarse pulverizer such as a stamp mill, a jaw crusher, a braun mill and the like in the atmosphere of an inert gas. Before coarse pulverization, it is effective that hydrogen is adsorbed in the raw alloy, and then the hydrogen is released in order to perform pulverization. The purpose of hydrogen-releasing treatment is to reduce the hydrogen to be the impurities in the rare earth-based sintered magnet. The maintained heating temperature for absorbing hydrogen is set to be 200□ or more, preferably 350□ or more. The holding time depends on the relation with maintained temperature, the thickness of the raw alloy and etc., and it is set to be at least 30 min or more, preferably 1 hour or more. The hydrogen-releasing treatment is preformed in vacuum or in the airflow of Ar. Further, hydrogen-adsorbing treatment and hydrogen-releasing treatment is not necessary treatment. The hydrogen pulverization also can be defined as the coarse pulverization to omit a mechanical coarse pulverization.

After the coarse pulverization, the fine pulverization is performed. During the fine pulverization, a jet mill is mainly used to pulverize the coarse pulverized powder having a particle diameter of approximately several hundred μm into be a fine pulverized powder with a particle diameter of 2.5~6 μm, preferably 3~5 μm. The jet mill discharges inert gas from a narrow nozzle at high pressure and generates high speed airflow. The coarse pulverized powder is accelerated with the high speed airflow, causing a collision between coarse pulverized powders with each other or a collision between coarse pulverized powders and a target or a container wall.

The wet pulverization also can be applied in the fine pulverization. In the wet pulverization, a ball mill, wet attritor or the like can be used to pulverize the coarse pulverized powder having a particle diameter of approximately several hundred μm into a fine pulverized powder with a particle diameter of 1.5~5.0 μm, preferably 2.0~4.5 μm. Since dispersion medium can be appropriately chosen in the wet pulverization to perform pulverization with magnet powders unexposed to oxygen, the fine powder with low oxygen concentration can be obtained.

During the fine pulverization, a fatty acid or a derivative of the fatty acid or a hydrocarbon, such as zinc stearate, calcium stearate, aluminium stearate, stearic amide, oleic amide, ethylene bis-isostearic amide as stearic acids or oleic acids; paraffin, naphthalene as hydrocarbons and the like with the range of about 0.01~0.3 mass % can be added so as to improve lubrication and orientation at molding.

The fine powder is molded in the magnetic field.

The molding pressure when molding in the magnetic field can be set at the range of 0.3~3 ton/cm$^2$ (30~300 MPa). The molding pressure can be constant from beginning to end, and also can be increased or decreased gradually, or it can be randomly changed. The molding pressure is lower, the orientation is better. However, if the molding pressure is too low, the problem would be brought during the handling due to insufficient strength of the shaped body. From this point, the molding pressure can be selected from the above range. The final relative density of the obtained shape formed article molded in the magnetic field is usually 40~60%.

The magnetic field is applied in the range of about 10~20 kOe (960~1600 kA/m). The applied magnetic field is not limited to a magnetostatic field, and it can also be a pulsed magnetic field. In addition, a magnetostatic field and a pulsed magnetic field can be used together.

Subsequently, the shape formed article is sintered in a vacuum or an inert gas atmosphere. A sintering temperature is required to be adjusted considering many conditions, such as composition, pulverization method, a difference of average particle diameter and grain size distribution and the like. The shape formed article is sintered at 1000~1200° C. for 1 hour to 8 hours.

After sintering, the obtained sintered body is aging treated. The step is important step to control coercivity. When the aging treatment is divided into two stages, it is effective to hold for a predetermined time at 800° C. nearby and at 600□ nearby. If the heating treatment is performed at 800□ nearby after sintering, coercivity increases. In addition, as coercivity is greatly increased when heating treated at 600□ nearby, the aging treatment can be performed at 600□ nearby when the aging treatment being one stage.

EXAMPLES

Hereinafter, Examples and Comparative examples are used to describe the present invention in detail. However, the present invention is not limited to the following Examples.

Experimental Example 1

Examples 1 to 7 and Comparative Examples 1 to 2

The mixing method was adopted to produce the raw material powders. The composition of the low R alloy was 15.0 mol % Nd—6.5 mol % B—Fe (balance) as base with the addition of 0.5 mass % of Co, 0.18 mass % of Al and 0.1 mass % of Cu. The high R alloy was 22.3 mol % R—Fe (balance). As the high R alloy, the molar ratio of R1 to Y was changed from 80:20 to 10:90. The weight ratio of the low R alloy and the high R alloy was 90:10. The metals or alloys of the raw materials were combined as to be the above composition. The raw alloy sheets were produced by strip casting method.

The obtained raw alloy sheets were subjected to the hydrogen pulverization to obtain the coarsely pulverized powders. Oleic amide was added to the coarsely pulverized powders as the lubricant. Thereafter, a fine pulverization was performed under high pressure in the atmosphere of $N_2$ gas by using a jet mill to obtain a fine pulverization powder.

Subsequently, the finely pulverized powders were molded in a magnetic field. To be specific, molding was performed in the magnetic field of 1200 kA/m (15 kOe) under a pressure of 140 MPa, and then a shaped body with the size of 20 mm×18 mm×13 mm was obtained. The direction of the magnetic field was a direction vertical to the pressing direction. Then the obtained shaped body was fired at 1090° C. for 2 hours. Thereafter, an aging treatment for one hour at 850° C. and another hour at 530° C. was provided so that a sintered body was obtained.

The ratio of R1 to Y in the grain boundary was calculated according to the following method. Since various products such as oxides, nitrides, segregating substance and the like were contained in the grain boundary phase, it is not realistic to find out the average composition of the grain boundary phase by EPMA and the like. Therefore, the composition could be calculated base on the composition of the $R_2$—$F_{14}$—B crystal grains and the generation rate of $R_2$—$F_{14}$—B crystal grains.

The composition of the polished samples was analyzed by using EPMA. The $R_2$—$F_{14}$—B crystal grains were assigned by observing backscattered electron images of an electron microscopy and EPMA images. The quantitative analysis was performed based on at least respective 3 points at the internal of at least 10 crystal grains to obtain the average composition of the $R_2$—$F_{14}$—B crystal grains.

The amount of the $R_2$—$F_{14}$—B crystal occupied in the sintered body was calculated. Firstly, the composition of the whole sintered body was obtained by using ICP-AES (i.e., inductive coupled plasma emission spectrometer). Since the sintered magnet was produced with the composition in which R is more than the stoichiometric composition of $R_2$—$F_{14}$—B, the composition of the whole sintered body was the one in which Fe or B was short on the basis of the amount of R, relative to $R_2$—$F_{14}$—B. If the amount of $R_2$—$F_{14}$—B phase was calculated based on the element that was shorter between Fe and B, the generation proportion of $R_2$—$F_{14}$—B occupied in the whole sintered body was obtained.

When the composition of the $R_2$—$F_{14}$—B crystal grains in the sintered body and the generation proportion of the $R_2$—$F_{14}$—B phase in the sintered body were known, the average composition of the grain boundary phase could be calculated by subtracting the $R_2$—$F_{14}$—B phase portion from the whole composition. Thus, the ratio of R1 to Y in the grain boundary phase was obtained as the calculated ratio of R1 to Y in the grain boundary phase.

The obtained sintered body was processed into the plate with 13 mm×8 mm×2 mm. The plate magnet was placed at 120° C. under the pressure of 2 atm in the atmosphere of saturated steam with 100% relative humidity. Corrosion resistance was evaluated by the period until the destruction of the magnet occurred caused by corrosion, i.e., the sharp decrease of weight occurred caused by the $R_2$—$F_{14}$—B crystal grains peeled off. The period until the destruction of the magnet begun was evaluated as the corrosion resistance of R-T-B based sintered magnets. The evaluation lasts 2 weeks (336 hours) at most.

The obtained sintered body was processed into the plate with 12 mm×10 mm×13 mm. The residual flux density (Br) and the coercivity (HcJ) of these samples were measured by a BH tracer. These results were shown in Table 1.

TABLE 1

| | Species of R1 | Molar ratio of R1 to Y: High R alloy | Molar ratio of R1 to Y: Calculated grain boundary phase | Corrosion resistance | Br (mT) | HcJ (kA/m) |
|---|---|---|---|---|---|---|
| Example 1 | Nd | 75:25 | 79:21 | 288 h | 1435 | 976 |
| Example 2 | Nd | 70:30 | 73:27 | 336 h without corrosion | 1426 | 966 |
| Example 3 | Nd | 50:50 | 58:42 | 336 h without corrosion | 1421 | 956 |
| Example 4 | Nd | 40:60 | 55:45 | 336 h without corrosion | 1425 | 945 |
| Example 5 | Nd | 30:70 | 42:58 | 264 h | 1406 | 943 |
| Example 6 | Nd | 25:75 | 36:64 | 216 h | 1425 | 928 |
| Example 7 | Nd, Pr | 50:50 | 59:41 | 336 h without corrosion | 1408 | 976 |

TABLE 1-continued

| | Species of R1 | Molar ratio of R1 to Y: High R alloy | Calculated grain boundary phase | Corrosion resistance | Br (mT) | HcJ (kA/m) |
|---|---|---|---|---|---|---|
| Example 8 | Nd, Dy | 50:50 | 57:43 | 336 h without corrosion | 1384 | 1177 |
| Comparative Example 1 | Nd | 80:20 | 88:12 | 192 h | 1430 | 983 |
| Comparative Example 2 | Nd | 20:80 | 32:68 | 168 h | 1398 | 941 |
| Comparative Example 3 | Nd | 10:90 | 25:75 | 144 h | 1398 | 952 |

It could be seen from Examples 1 to 8 that the concentration of Y in the calculated grain boundary phase was lower than that in the high R alloy. The reason is that Y was not contained in the main phase, and thus Y diffused to the $R_2$—$F_{14}$—B grains during the heating treatment. It could be known that high corrosion resistance was shown when the molar ratio of R1 to Y in the calculated grain boundary phase was at the range of 80:20~35:65. If exceeding the range, the corrosion resistance became lower. Nd as the grain boundary phase existed in a large amount at the region where Y is less than the above range, and thus corrosion occurred due to hydrogen adsorption. The segregation of Y was difficult to arise at the region where Y is more than the above range, still leading to corrosion due to hydrogen adsorption.

Especially when the molar ratio of R1 to Y in the calculated grain boundary phase was 75:25 to 45:55, both high corrosion resistance and magnetic properties were obtained. The magnetic anisotropy field of $Y_2$—$Fe_{14}$—B was about ⅓ of that of $Nd_2$—$Fe_{14}$—B. If Y is too much, the coercivity reduced.

Experimental Example 2

Examples 7~8

The composition of the low R alloy was 15.0 mol % R1-6.5 mol % B—Fe (balance) as base with the addition of 0.5 mass % of Co, 0.18 mass % of Al and 0.1 mass % of Cu. The high R alloy was 22.3 mol % R—Fe (balance). The ratio of R1 to Y in the high R alloy was 50:50. The weight ratio of the low R alloy and the high R alloy was 90:10. The molar ratio of Nd to Pr in R1 was set to be Nd:Pr=75:25 in Example 8. The molar ratio of Nd to Dy in R1 was set to be Nd:Dy=99:3 in Example 9. Besides, the samples were prepared as in Example 1.

Even when the components except Nd was used as R1, the high corrosion resistance was shown, which was the same as in Examples 1~6.

What is claimed is:

1. A R-T-B based sintered magnet, wherein:

R contains Y and R1,

Y is yttrium,

R1 is at least one rare earth element except Y but contains Nd, and

T represents at least one transition metal element containing Fe or a combination of Fe and Co, a ratio of R1 to Y (R1:Y) in a grain boundary phase is 73:27 to 55:45 in terms of a calculated molar ratio of the grain boundary phase.

2. The R-T-B based sintered magnet according to claim 1, wherein T represents Fe only.

3. The R-T-B based sintered magnet according to claim 1, wherein T represents a combination of Fe and Co only.

4. The R-T-B based sintered magnet according to claim 3, wherein the Co is present in an amount of 4.0 at % or less.

5. The R-T-B based sintered magnet according to claim 1, which additionally contains at least one of Al and Cu in a total amount of about 0.01-1.2 at %.

* * * * *